US009268273B2

(12) United States Patent
Miyahara et al.

(10) Patent No.: US 9,268,273 B2
(45) Date of Patent: Feb. 23, 2016

(54) PRESSURE APPLYING ROTATABLE MEMBER, HAVING A POROUS ELASTIC LAYER WITH GREATER THERMAL CONDUCTIVITIES IN THE AXIAL AND CIRCUMFERENTIAL DIRECTIONS THAN IN THE THICKNESS DIRECTION, AND IMAGE HEATING APPARATUS HAVING THE SAME

(71) Applicant: CANON KABUSHIKI KAISHA, Tokyo (JP)

(72) Inventors: Yasuhiro Miyahara, Tokyo (JP); Shigeaki Takada, Abiko (JP); Toshinori Nakayama, Kashiwa (JP); Daigo Matsuura, Toride (JP); Naoki Akiyama, Toride (JP); Shuichi Tamura, Moriya (JP); Yutaka Arai, Kawasaki (JP); Jun Miura, Kawasaki (JP); Takeshi Suzuki, Yokohama (JP); Katsuhisa Matsunaka, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/480,811

(22) Filed: Sep. 9, 2014

(65) Prior Publication Data

US 2015/0071690 A1 Mar. 12, 2015

(30) Foreign Application Priority Data

Sep. 10, 2013 (JP) ..... 2013-187234

(51) Int. Cl.
*G03G 15/20* (2006.01)

(52) U.S. Cl.
CPC ..... *G03G 15/206* (2013.01); *G03G 2215/2029* (2013.01)

(58) Field of Classification Search
CPC ..... G03G 15/2089; G03G 15/206
USPC ..... 399/333, 331
See application file for complete search history.

(56) References Cited

U.S. PATENT DOCUMENTS

| | | | | |
|---|---|---|---|---|
| 6,002,910 | A * | 12/1999 | Eddy et al. | 399/329 |
| 7,321,746 | B2 | 1/2008 | Sakakibara et al. | |
| 2012/0014726 | A1 * | 1/2012 | Sekihara et al. | 399/333 |
| 2014/0133892 | A1 | 5/2014 | Miura et al. | |
| 2014/0248071 | A1 | 9/2014 | Matsunaka et al. | |
| 2014/0255067 | A1 | 9/2014 | Matsunaka et al. | |
| 2014/0255068 | A1 | 9/2014 | Matsunaka et al. | |
| 2014/0301763 | A1 | 10/2014 | Miura et al. | |

FOREIGN PATENT DOCUMENTS

| | | | |
|---|---|---|---|
| JP | 2005-273771 | A | 10/2005 |
| WO | 2014/097616 | A1 | 6/2014 |
| WO | 2014/103252 | A1 | 7/2014 |
| WO | 2014/112358 | A1 | 7/2014 |

* cited by examiner

*Primary Examiner* — Billy Lactaoen
(74) *Attorney, Agent, or Firm* — Fitzpatrick, Cella, Harper & Scinto

(57) ABSTRACT

A pressing rotatable member for use with an image heating apparatus including a base layer; and a porous elastic layer provided on the base layer, wherein the elastic layer has a thermal conductivity in an axial direction thereof and a thermal conductivity in a circumferential direction thereof which are not less than 6-times and not more than 900-times a thermal conductivity in a thickness direction thereof.

20 Claims, 9 Drawing Sheets

PRESSURE APPLYING ROTATABLE MEMBER, HAVING A POROUS ELASTIC LAYER WITH GREATER THERMAL CONDUCTIVITIES IN THE AXIAL AND CIRCUMFERENTIAL DIRECTIONS THAN IN THE THICKNESS DIRECTION, AND IMAGE HEATING APPARATUS HAVING THE SAME

FIELD OF THE INVENTION AND RELATED ART

The present invention relates to a pressure applying rotational member and an image heating apparatus (device) equipped with a pressure applying rotational member.

In the field of an image forming apparatus which forms a toner image on a sheet of recording paper with the use of an electrophotographic image formation process, it has been a common practice to fix a toner image by applying heat and pressure to the sheet and the toner image thereon with the use of a fixing apparatus (image heating apparatus).

In a case where a substantial number of sheets of recording paper which are narrower than a largest sheet of recording paper conveyable through a fixing apparatus (device) are continuously conveyed through a fixing apparatus such as the abovementioned one to fix the toner images thereon, the portions of the fixing member (rotational heating member) of the fixing apparatus, which do not come into contact with the sheets, tend to become higher in temperature than the portion of the fixing member, which is within the recording paper path. Hereafter, these portions of the fixing member, which do not come into contact with the sheets, will be referred to as "out-of-sheet-path portions" of the fixing member, whereas the portion of the fixing member, which comes into contact with the sheets, will be referred to as "sheet-path portion" of the fixing member. This phenomenon occurs because the "out-of-sheet-path portions" of the fixing member are not robbed of heat by a sheet of recording paper. Hereafter, this phenomenon may be referred to simply as "out-of-sheet-path temperature increase".

Thus, there have been made various proposals to prevent the occurrence of the above-described phenomenon. In the case of the fixing device disclosed in Japanese Laid-open Patent Application 2005-273771 (which corresponds to U.S. Pat. No. 7,321,746), its pressure applying member (pressure applying rotational member), which forms a nip between itself and the fixing member of the fixing device has been devised in structure.

More concretely, in order to minimize the unwanted temperature increase of the out-of-sheet path portions of the pressure applying member, the solid rubber layer of the pressure applying member is formed of a substance which contains needle-shaped fillers which are capable of improving the solid rubber layer in thermal conductivity.

From the standpoint of minimizing the unwanted temperature increase of the out-of-sheet-path portions of the pressure applying member, the structure of the fixing apparatus disclosed in Japanese Laid-open Patent Application 2005-273771 may be said to be a desirable one. However, there is a concern that the length of time required to start up this fixing device may be affected by the direction in which the needle-like fillers point; making the needle-like fillers point in a certain direction may result in the increase in the length of time required to start up the fixing device. In other words, the fixing device disclosed in this patent application can be improved in this respect.

SUMMARY OF THE INVENTION

According to an aspect of the present invention, there is provided a pressing rotatable member for use with an image heating apparatus, said pressing rotatable member comprising a base layer; and a porous elastic layer provided on said base layer, wherein said elastic layer has a thermal conductivity in an axial direction thereof and a thermal conductivity in a circumferential direction thereof which are not less than 6-times and not more than 900-times a thermal conductivity in a thickness direction thereof.

According to another aspect of the present invention, there is provided an image heating apparatus comprising a heating rotatable member for heating a toner image on sheet; and a pressing rotatable member configured to cooperate with said heating rotatable member to form a nip, wherein said pressing rotatable member includes a base layer and a porous elastic layer provided on said base layer, wherein said elastic layer has a thermal conductivity in an axial direction thereof and a thermal conductivity in a circumferential direction thereof which are not less than 6-times and not more than 900-times a thermal conductivity in a thickness direction thereof.

Further features of the present invention will become apparent from the following description of exemplary embodiments (with reference to the attached drawings).

BRIEF DESCRIPTION OF THE DRAWINGS

FIG. 6(*b*), an enlarged schematic drawing of the surface b of the sample, which is perpendicular to the thickness direction of the elastic layer, and parallel to the axial line of the pressure roller; and FIG. 6(*c*) is an enlarged schematic drawing of the surface c of the sample, which is perpendicular to the thickness direction of the elastic layer, and perpendicular to the axial line of the pressure roller.

DESCRIPTION OF THE PREFERRED EMBODIMENTS

Hereinafter, the present invention is described with reference to a pressure applying rotational member employed by an image heating apparatus (device). However, these embodiments are not intended to limit the present invention in scope. That is, the present invention is also applicable to various image heating apparatuses and their pressure applying rotational members, which are different from those in the embodiments, within the scope of the present invention.

Embodiment 1

(1) Image Forming Section

Figure 1:
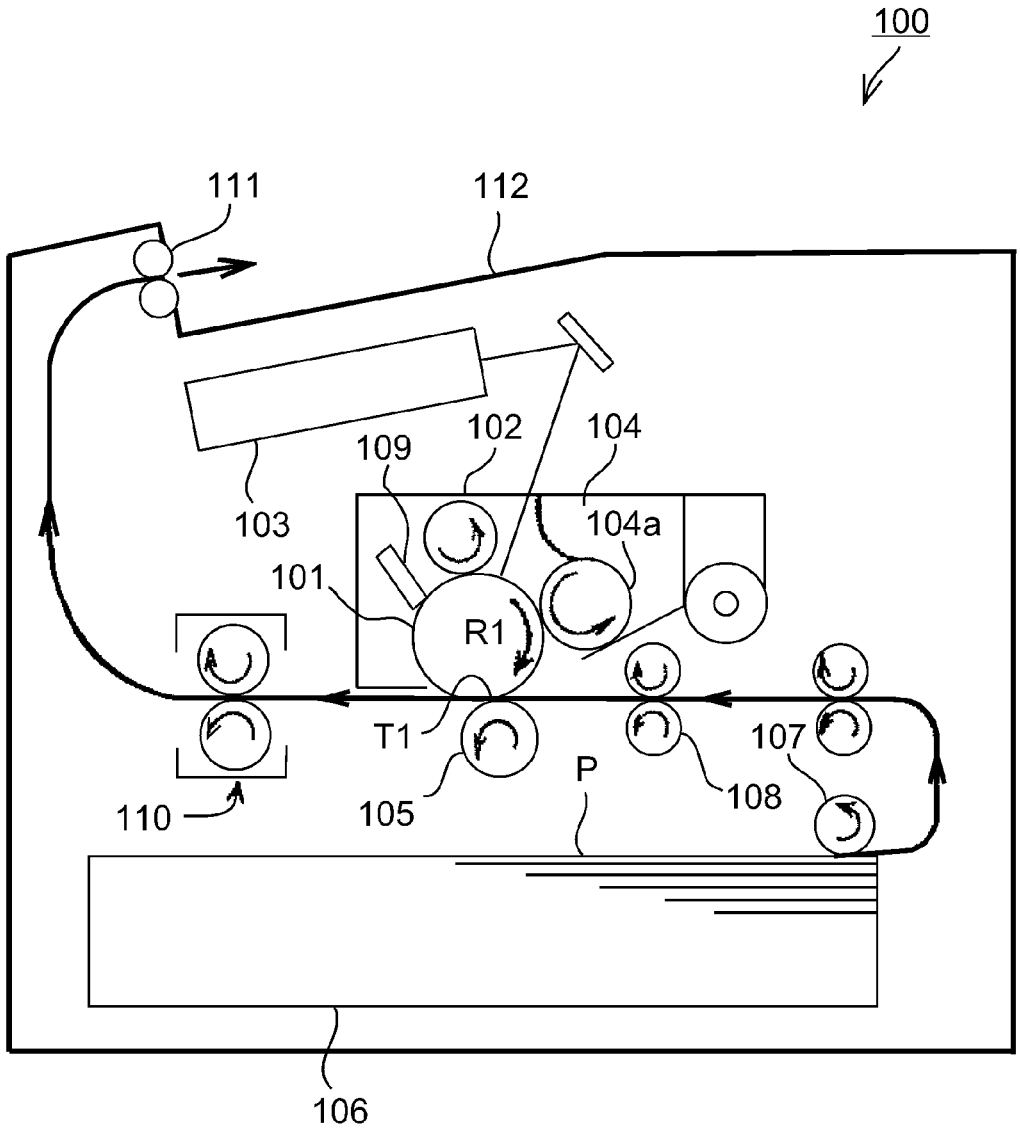
FIG. 1 is a schematic sectional view of a typical image forming apparatus which is compatible with the present invention, and shows the general structure of the apparatus.

FIG. 1 is a schematic vertical sectional view of an electrophotographic printer 100, which is an example of an image forming apparatus employing a fixing device 110 as an image heating device which is in accordance with the present invention. It shows the general structure of the printer 100. First, the image forming section of the printer 100 is described about its general structure. This printer 100 electrophotographically forms a toner image, transfers the toner image onto a sheet P of recording medium, and thermally fixes the toner image to the sheet P of recording medium with the use of its fixing device 110.

A sheet P of recording medium is a medium across which an image is formed by an image forming apparatus. It includes a specifically, or nonspecifically, shaped sheet of ordinary paper, cardstock, thin paper, resinous recording medium, OHP film, glossy paper, etc., for example. Further, it includes envelopes and postcards. Hereafter, it may be referred to simply as recording paper. Further, in the following description of the embodiments of the present invention, such terms as sheet conveyance, sheet discharge, sheet feeding, sheet-path portion, out-of-sheet-path portions, etc., are used to describe how a sheet of recording paper is conveyed through the fixing device. However, these embodiments are not intended to limit the selection of recording medium to only a sheet of paper.

The printer 100 has a photosensitive drum 101. It has also a charge roller 102, an exposing device 103, a developing device 104, a transfer roller 105, and a cleaning device 109, which are in the adjacencies of the peripheral surface of the photosensitive drum 101. The photosensitive drum 101 is made up of an aluminum cylinder as a substrate, and a photosensitive layer formed on the peripheral surface of the aluminum cylinder, of negatively chargeable organic photosensitive substance. It is rotated in the direction indicated by an arrow mark R1 at a process speed of 300 mm/sec.

The charge roller 102 is in contact with the photosensitive drum 101, and is rotated by the rotation of the photosensitive drum 101. As an oscillatory voltage, more specifically, a combination of DC voltage and AC voltage, is applied to the charge roller 102 from an unshown electric power source, the charge roller 102 uniformly charges the peripheral surface of the photosensitive drum 101 to negative potential level VD (pre-exposure potential level). The exposing device 103 scans the uniformly charged portion of the peripheral surface of the photosensitive drum 101, with the beam of laser light which it emits while modulating (turning on or off) the beam with image formation signals obtained from the data of the image to be formed. As a given point of the charged portion of the peripheral surface of the photosensitive drum 101 is exposed to the beam of laser light, it is reduced in the amount of electric charge. That is, its potential level reduces from the pre-exposure level VD to post-exposure level VL. Consequently, an electrostatic image of the image to be formed is effected on the peripheral surface of the photosensitive drum 101.

The developing device 104 has a development sleeve 104*a*, by which negatively charged single-component developer is magnetically borne, and is conveyed to the area in which the peripheral surface of the development sleeve 104*a* is virtually in contact with the peripheral surface of the photosensitive drum 101. As an oscillatory voltage, which is a combination of negative DC voltage Vdc and an AC voltage, is applied to the development sleeve 104*a* from an unshown electric power source, the negatively charged toner on the peripheral surface of the development sleeve 104*a* adheres to the points of the peripheral surface of the photosensitive drum 101, which are VD in potential level. In other words, the electrostatic image on the peripheral surface of the photosensitive drum 101 is developed in reverse.

The transfer roller 105 is pressed on the photosensitive drum 101, whereby it forms a transfer section, through which a sheet P of recording paper is conveyed while remaining pinched between the photosensitive drum 101 and transfer roller 105. As positive voltage is applied to the transfer roller 105 from an unshown electric power source, the negatively charged toner image on the photosensitive drum 101 is transferred onto the sheet P of recording paper which is being conveyed through the transfer section T1.

A sheet P of recording paper is moved out of a cassette 106 by a sheet feeder roller 107, and is sent to a pair of registration rollers 108, by which it is temporarily held. Then, it is conveyed to the transfer section T1 by the pair of registration rollers 10, in synchronism with the movement of the toner image on the photosensitive drum 101 into the transfer section T1, in which the toner image is transferred onto the sheet P. Then, the sheet P is separated from the photosensitive drum 101, and is sent to the fixing device 110.

The fixing device 110 fixes the unfixed toner image on the sheet P of recording paper, by applying heat and pressure to the sheet P and the toner image thereon. After the fixation of the toner image to the sheet P, the sheet P is discharged by a pair of discharge rollers 111 into a delivery tray, which is a part of the top wall of the image forming apparatus, so that it will be layered upon the sheets P in the delivery tray. The cleaning device 109 removes the transfer residual toner, that is, the toner having passed through the transferring section T1 and remaining on the peripheral surface of the photosensitive drum 101, by scraping the peripheral surface of the photosensitive drum 101 with its cleaning blade.

(2) Fixing Device

Figure 2:
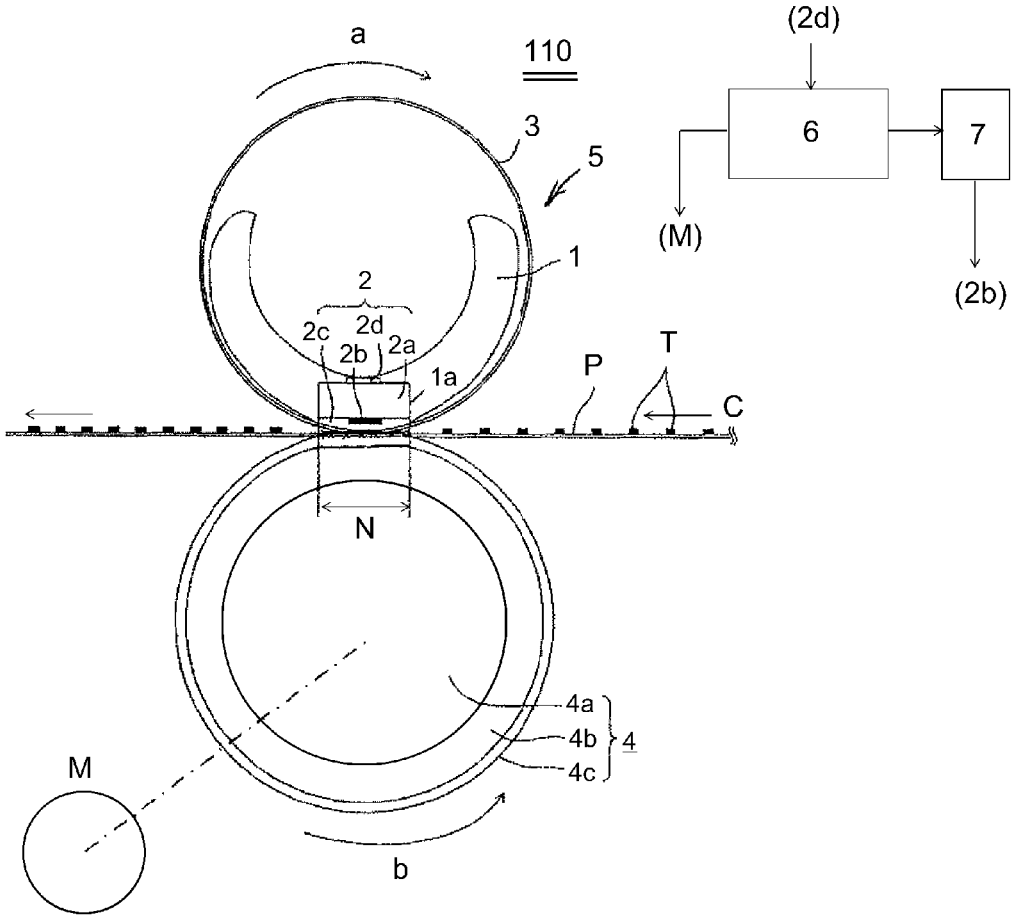
FIG. 2 is a schematic cross-sectional view of the essential portions of a typical fixing device (which hereafter may be referred to as image heating device) which is compatible with the present invention, and shows the general structure of the fixing device.

FIG. 2 is a cross-sectional view of the essential components of the fixing device 110 in this embodiment, and shows the general structure of the fixing device 110. This fixing device 110 is an image heating device of the so-called heating belt (film) type, and also, of the so-called tension-less type. Next, the general structure of the fixing device 110 is described.

Regarding the positioning of the fixing device 110 and/or the structural components of the fixing device 110, the "front side" means where the sheet entrance is, and the "rear side", means the opposite side from the front side, that is, where the sheet exit is. The "left or right side" of the fixing device 110 means the left or right side of the fixing device 110 as the fixing device 110 is seen from its front side. Further, the "upstream or downstream" side of the fixing device 110 means the upstream or downstream side with reference to the direction c in which a sheet P of recording paper is conveyed (recording medium advancement direction). Further, the "lengthwise direction (widthwise direction)" means the lengthwise direction with reference to the direction which is perpendicular, or virtually perpendicular, to the recording medium conveyance direction c. The "widthwise direction" of a sheet P of recording paper means the direction of the sheet P with reference to the direction which is practically parallel to the recording medium conveyance direction c. Further, the "thickness direction" means the direction which is perpendicular to the surface of a sheet P of recording paper.

This fixing device 110 is structured so that when a sheet P of recording paper is conveyed through the fixing device 110, the center of the sheet P coincides with the centerline of the recording medium passage of the fixing device 110, in terms of the direction perpendicular to the recording medium conveyance direction c. Incidentally, the present invention is also applicable to a fixing device structured so that when a sheet P of recording paper is conveyed through the fixing device, one the edges of the sheet P, which is parallel to the recording medium conveyance direction c remains in contact with the corresponding edge of the recording medium passage of the fixing device. Hereafter, the widest sheet of recording medium, which is usable with this fixing device (image forming apparatus) will be referred to as a sheet of recording medium of a large size (large sheet), and sheets of recording medium which are narrower than the large sheet will be referred to as sheets of a small size (small sheets).

The fixing device 110 in this embodiment has: a heating belt 3 which is a rotational heating member, and a pressure roller 4 which is a pressure applying rotational member, and forms the nip N in coordination with the heating belt 3. The heating belt 3 is disposed so that it contacts the surface of a sheet P of recording paper, on which a toner image is present, whereas the pressure roller 4 is disposed so that it contacts the opposite surface of the sheet P from the surface on which the toner image is present.

A referential code 1 stands for the belt guiding member of the heating belt unit 5. The belt guiding member 1 is shaped like a trough, and is roughly semicircular in cross-section. Its lengthwise direction is perpendicular to the surface of the sheet of paper having the drawing. It is molded of heat resistant resin, such as PPS (polyphenylenesulfite) and liquid polymer.

A referential code 2 stands for a heater (heat source: one of components of heating member), which is long and narrow. The heating member 2 is held in a groove 1*a* formed in the downwardly facing surface of a guiding member 1 in such a manner that its lengthwise direction is parallel to the lengthwise direction of the guiding member 1, and also, that it is located at roughly center of the guiding member 1 in terms of the widthwise direction of the guiding member 1. A referential code 3 stands for a flexible endless belt (heat belt, endless film). The belt 3 is cylindrical, and is loosely fitted around the combination of the guiding member 1 and heater 2.

The heater 2 in this embodiment is a ceramic heater. It is made up of a ceramic substrate, and a heat generating resistor attached to the ceramic substrate. More specifically, the heater 2, shown in FIG. 2, has: a substrate 2*a*, which is made of a long, narrow, and thin piece of alumina; and a heat generating resistor 2*b* (which generates heat as electric current is flowed though it), which is formed of Ag/Pd, on the surface of the substrate 2*a*, which faces the heating belt 3. The heat generating resistor 2*b* is in the form of a straight line, or a long, narrow, and straight stripe. Further, the heater 2 has a surface protection layer 2*c* which covers the heat generating resistor 2*b* to protect the resistor 2*b*. The surface protection layer is a thin layer of glass or the like.

Further, the fixing device 110 is provided with a temperature detection element 2*d*, such as a thermistor, which is on the back side of the heater substrate 2*a*. As electric power is supplied to the heat generating resistor 2*b* of this heater 2 from an electric power source 7 which is under the control from a control circuit 6, the heater quickly increases in temperature. The information related to the temperature of the heater 2 is inputted from the temperature detection element 2*d* into the control circuit 6, which controls the electric power to be supplied to the heat generating resistor 2*b* from the electric power source 7, based on the temperature information inputted from the temperature detection element 2, in such a manner that the temperature of the heater 2 increases to, and remains at, a preset level (target temperature level).

From the standpoint of enabling the fixing device 110 to start up quickly, the belt 3 is desired to be small in thermal capacity. In this embodiment, therefore, the belt 3 is made to be no more than 100 μm in overall thickness. Preferably, it is desired to be no less than 20 μm and no more than 60 μm in thickness. It is made of multilayer film having a base film (substrate) and a surface layer coated on the surface of the base film.

As for the material for the base film, a resinous substance such as PI (polyamide), PAI (polyamideimide), PEEK (polyetheretherketone), and PES (polyether-sulfone), or a metallic substance such as SUS and Ni, can be used.

As the material for the surface layer, a fluorinated resinous substance such as PTFE (polytetrafluoroethylene), PFA (tetrafluoroethylene-perfluoroalkylvinylether), and FEP (tetrafluoro-ethylene-perfluoroalkylvinylether) can be used.

Figure 3:
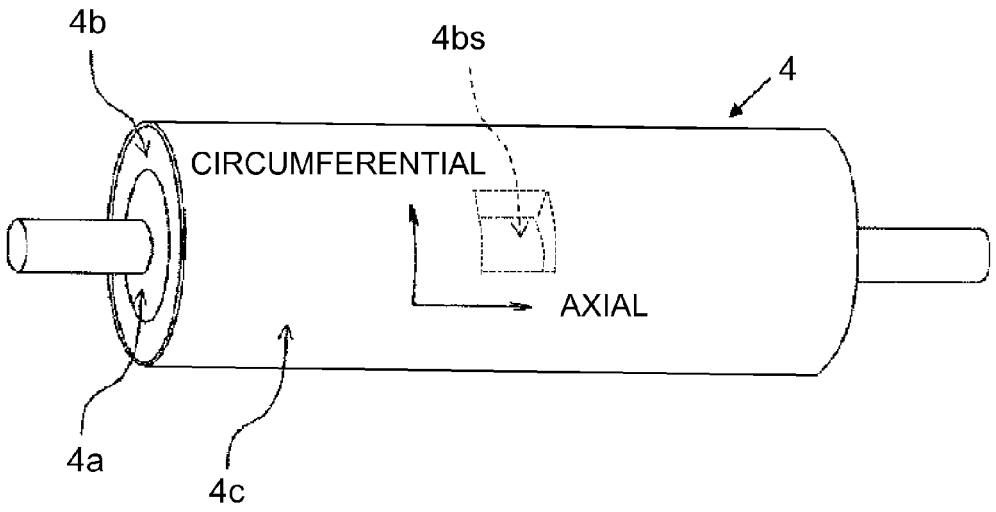
FIG. 3 is a perspective view of a pressure roller (pressure applying member).

FIG. 3 is a schematic perspective view of the pressure roller 4 as a pressure applying rotational member. The pressure roller 4 has: a metallic core (which hereafter may be referred to as substrate or base layer) 4*a*, which is formed of iron, aluminum, or the like; an elastic layer 4*b* coaxially formed, like a cylindrical roller, around the substrate 4*a*, of silicone rubber and additives; and a parting layer 4*c* formed around the elastic layer 4*b*, of fluorinated resin or the like.

The pressure roller 4 is kept pressed upon the surface protection layer 2*c* of the heater 2 of the abovementioned heating belt unit 5 by a pressure application mechanism (unshown), with the placement of the belt 3 between itself and the surface protection layer 2*c*, with the application of a preset amount of force. Thus, the elastic layer 4*b* remains elastically deformed by the amount proportional to the amount of pressure applied to the pressure roller 4, forming thereby the nip N between the peripheral surface of the pressure roller 4 and the outward surface of the belt 3. In terms of the direction parallel to the recording medium conveyance direction c, the nip N has a preset width which is necessary to thermally fix an unfixed toner image T. In this embodiment, the abovementioned width of the nip N is such that the length of time the belt 3 and pressure roller 4 remain in contact with each other is roughly 20-80 ms.

The driving force of a driving power source is transmitted to the pressure roller 4 through a driving force transmitting mechanism made up of unshown gears, and the like. Thus, the pressure roller 4 is rotationally driven in the counterclockwise direction, indicated by an arrow mark b, at a preset peripheral velocity. As for the belt 3, as the pressure roller 4 is rotationally driven in the counterclockwise direction indicated by the arrow mark b during an image forming operation, it is rotated by the rotation of the pressure roller 4 in the clockwise direction indicated by an arrow mark a.

While the pressure roller 4 is rotationally driven; the belt 3 is rotated by the rotation of the pressure roller 4; and the temperature of the heater 2 is kept at the preset level after being raised to the preset level, a sheet P of recording paper, on which an unfixed toner image T is present, is conveyed toward the fixing device 110 from the image forming section side of the image forming apparatus, is introduced into the nip N, and then, is conveyed through the nip N while remaining pinched between the pressure roller 4 and belt 3, and being subjected to the heat from the heater 2, and the pressure in the nip N. Thus, the toner image T on the sheet P of recording paper is melted by the heat, and welded to the surface of the sheet P by the internal pressure of the nip N. After being moved out of the nip N, the sheet P is separated from the belt 3 by the curvature of the belt 3, is discharged from the fixing device 110, and then, is conveyed further.

(3) Pressure Roller

Next, the materials for the pressure roller 4 (pressure applying rotational member), and the method for manufacturing the pressure roller 4, etc., are described in detail.

<Elastic Layer 4*b*>

Figure 6:
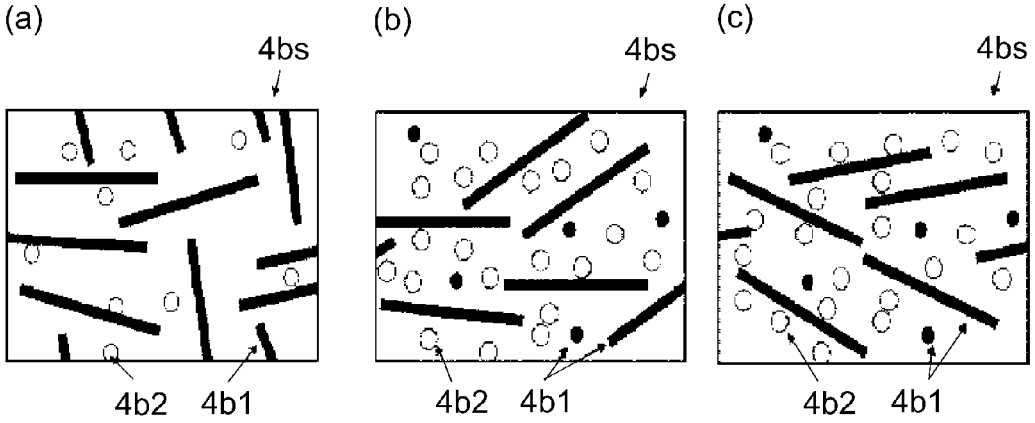
FIG. 6(*a*) is an enlarged schematic drawing of the surface a of the sample of the elastic layer of the elastic layer of the pressure roller.
Figure 7:
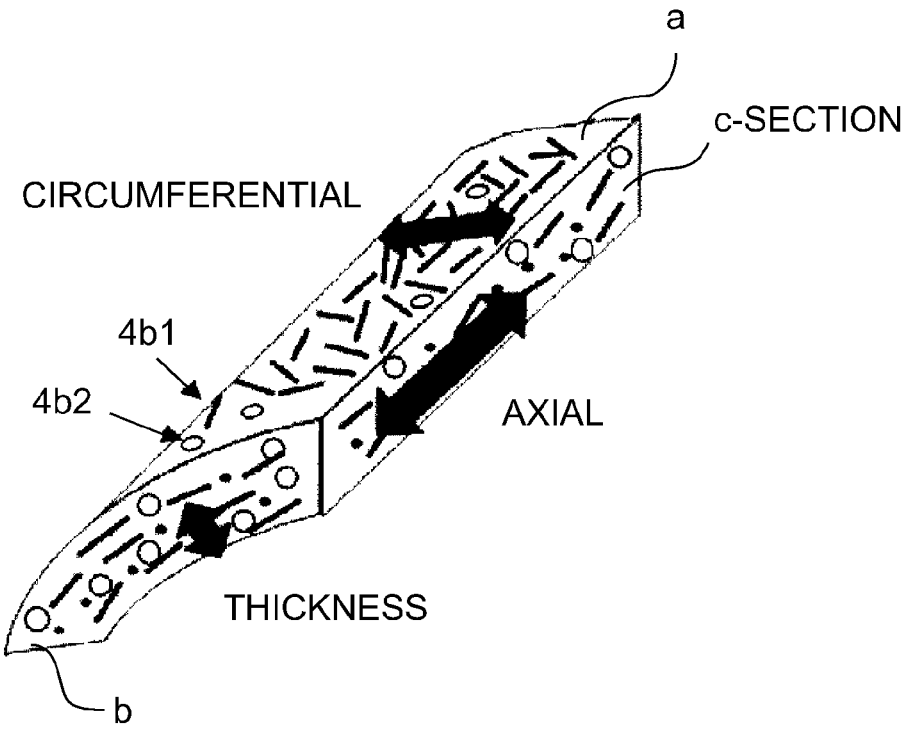
FIG. 7 is an enlarged perspective view of the sample piece of the elastic layer shown in FIG. 5.

First, the elastic layer 4*b* of the pressure roller 4 is described. The elastic layer 4*b* is required to be high in thermal conductivity in terms of the direction parallel to the axial line of the pressure roller 4 (which hereafter may be referred to as lengthwise direction), and also, in terms of the circumferential direction of the pressure roller 4, but, to be low in thermal conductivity in terms of its thickness direction. In this embodiment, the elastic layer 4*b* is formed of a substance which contains fillers, more specifically, needle-like fillers (FIGS. 6 and 7: pointed fillers, additives). It is formed so that the fillers point in the direction parallel to the axial line or circumferential direction of the pressure roller 4, in order to minimize its thermal conductivity in the thickness direction while maximizing the thermal conductivity in the direction parallel to the axial line and circumferential direction of the pressure roller 4. Further, in order to reduce the elastic layer 4*b* in thermal capacity, the elastic layer 4*b* was formed so that pores 4*b*2 were formed in the elastic layer 4*b* while the layer 4*b* was formed.

Figure 4:
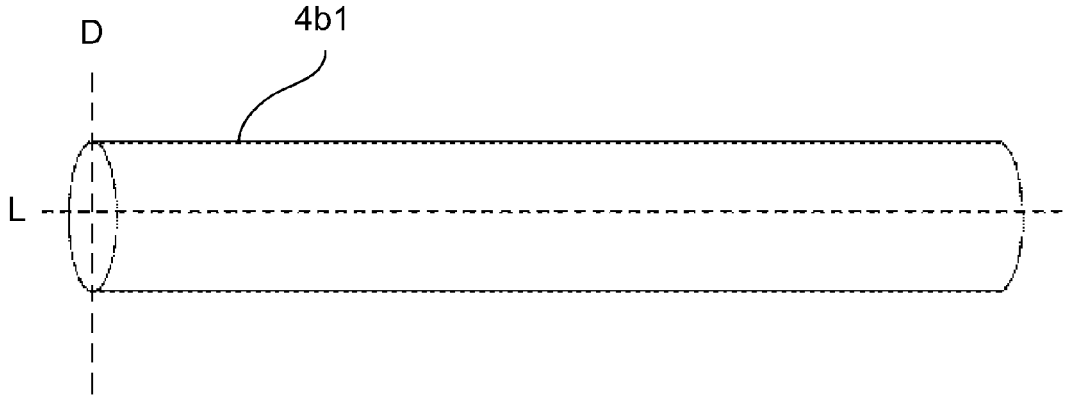
FIG. 4 is a schematic drawing of one of the needle-like fillers.

Next, referring to FIGS. 4-7, the elastic layer 4*b* is described in further detail. FIG. 4 is an enlarged perspective view of one of the needle-shaped fillers 4*b*1, which is D in diameter, and L in length. They are for describing the structure of the filler 4*b*1. The needle-shaped fillers 4*b*1 are in the elastic layer 4*b*, and point in the direction of the axial line of the pressure roller 4, or the direction parallel to the circumferential direction of the pressure roller 4. As for the physical properties, etc., of the needle-shaped filler 4*b*1, they are described later.

Figure 5:
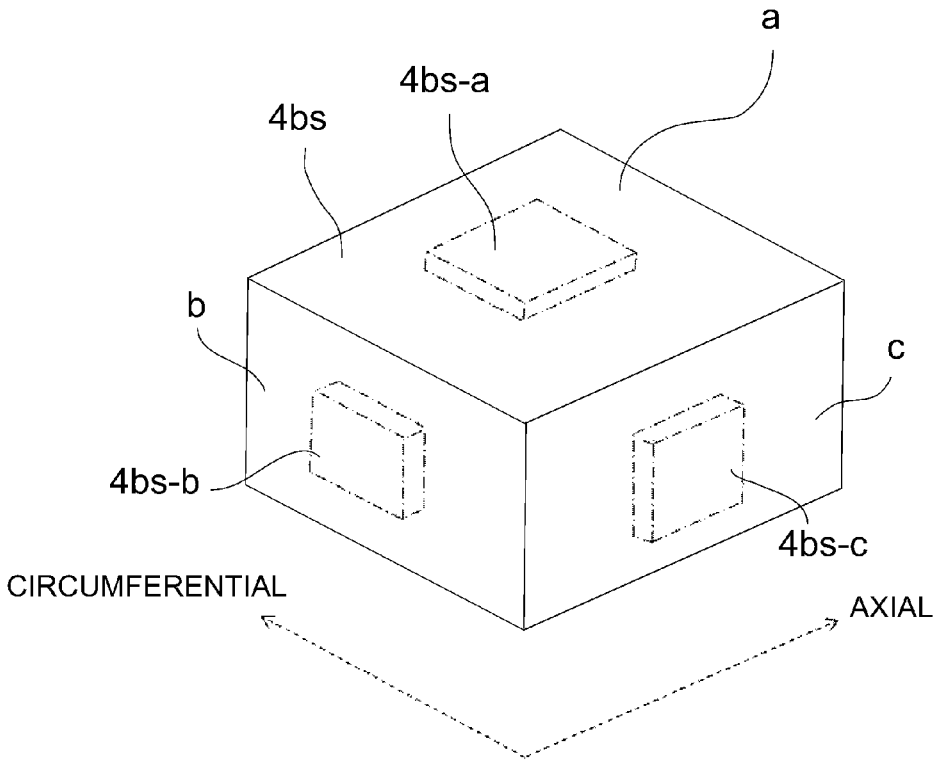
FIG. 5 is an enlarged schematic drawing of a piece (sample) of the elastic layer cut out of the pressure roller shown in FIG. 2.

FIG. 5 is an enlarged perspective view of a sample piece of elastic layer 4*b*, which was cut out of the pressure roller 4. The sample 4*bs* was cut out in such a manner that the three pairs of mutually opposing surfaces of the sample 4*bs* became parallel to the circumferential direction of the pressure roller 4, the lengthwise direction of the pressure roller 4, and the widthwise direction, one for one.

Referring to FIG. 6(*a*), which shows the surface (a) of the sample piece of the elastic layer 4*b*, which corresponds to the peripheral surface of the elastic layer 4*b*, it is visually apparent that the needle-shaped fillers 4*b*1 which are at the peripheral surface of the elastic layer 4*b* are mostly parallel to the peripheral surface of the elastic layer 4*b*. Next, referring to FIGS. 6(*b*) and 6(*c*), which shows the surfaces (b) and (c) of the sample piece of the elastic layer 4*b*, which are parallel to the lengthwise and circumferential directions, respectively, of the elastic layer 4*b*, it is visually apparent that some needle-shaped fillers 4*b*1 are parallel to the lengthwise direction of the elastic layer 4*b*, whereas the others are parallel to the circumferential direction of the elastic layer 4*b*. Further, all of FIGS. 6(*a*), 6(*b*) and 6(*c*) show pores 4*b*2 which are evenly distributed in the elastic layer 4*b*. FIG. 7 is an enlarged schematic perspective view of the elastic layer sample 4*bs*. It shows the structure of the elastic layer sample 4*bs* (elastic layer 4*b*).

Referring to FIG. 2, primary components of the elastic layer 4*b*, which characterize the elastic layer 4*b*, are the base polymer, pores 4*b*2, and needle-shaped fillers 4*b*1 of the elastic layer 4*b*. Next, these components are described in the listed order.

<Base Polymer>

The base polymer of the elastic layer 4*b* can be obtained by hardening that is, causing adductible liquid silicone rubber to cross-link. In other words, the elastic layer 4*b* contains a mixture of adductively hardenable silicone rubber.

The liquid silicone rubber which can be adductively hardened is such liquid silicone rubber that contains: organopolysiloxane (A), such as vinyl radical, having unsaturated bonds, and organopolysiloxane (B) having Si—H bond (hydride). As it is heated or subjected to the like procedure, its Si—H adducts to unsaturated bond of vinyl radical (cross-linking). Consequently, it hardens. Generally speaking, chemical compound that contains platinum is mixed as catalyst, which accelerate chemical reaction, in (A). This liquid silicone rubber of the so-called adductively hardening type can be adjusted in fluidity within a range in which the object of the present invention is not lost.

<Pore 4*b*2>

The needle-shaped fillers 4*b*1 and pores 4*b*2 coexist in the elastic layer 4*b*. Therefore, it is desired that the needle-shaped fillers 4*b*1 and pores 4*b*2 are disposed so that they do not interfere with each other.

The studies made by the inventors of the present invention revealed that creating pores in the elastic layer 4*b* with the use of foaming agent, hollow particles, or the like will possibly cause the needle-shaped fillers 4*b*1 to be erroneously disposed while the pores 4*b*2 are formed. The direction in which the needle-shaped fillers 4*b*1 point controls the direction in which heat is conducted in the elastic layer 4*b*. Therefore, misdirection of the needle-shaped fillers 4*b*1 reduces the effects of this embodiment (present invention) in terms of prevention of unwanted temperature increase of the out-of-sheet-path portions of the pressure roller 4, and also, in terms of reduction in the length of time it takes for the fixing device 110 to start up. Therefore, the misdirection of the needle-shaped fillers 4*b*1 is undesirable.

On the other hand, in a case where pores 4*b*2 are formed with the use of material formed by soaking water-absorbent polymer in water, the needle-shaped filler 4*b*1 are less likely to point in the unwanted direction than in the above-described case, for the following reason. That is, it seems reasonable to assume that as the liquid compound is made to flow, it reduces in viscosity because of thixotropic property which occurs to the liquid silicone rubber which can be adductively hardened and has not been subjected to cross-linking process, and in which the needle-shaped fillers 4*b*1 and the above described water-absorbent polymer soaked with water are coexistent (this liquid hereafter may be referred to simply as liquid compound).

Thus, it is preferred that the amount of pores 4*b*2 in the elastic layer 4*b* is no less than 10%, and no more than 70%, in volume. Keeping the pore ratio within the abovementioned range is effective to further reduce the length of the startup time.

<Needle-Shaped Filler 4*b*1>

Referring to FIG. 4, as a preferable needle-shaped filler 4*b*1, a needle-shaped filler shaped so that the ratio of its length relative to its diameter D is substantial can be used. That is, the needle-shaped filler 4b1 is desired to be high in aspect ratio. The shape of its bottom surface may be circular, or square, as long as the needle-shaped filler 4b1 can be made to point in specific directions with the use of an elastic layer forming method, which will be described later.

One of such needle-shaped fillers usable as the material for the elastic layer 4b is carbon fiber (CF) based on pitch. Using pitch-based carbon fiber which is no less than 500 W/(m·K) in thermal conductivity λ, as one of the materials for the elastic layer 4b, makes it possible to provide a preferable pressure roller 4. Further, using pitch-based carbon fiber which is shaped like a needle, as one of the materials for the elastic layer 4b, makes it possible to provide a more preferable pressure roller 4.

Forming the elastic layer 4b so that the needle-shaped (rod-shaped, hair-like) carbon fibers point in specific directions creates heat passages through which heat is transferred in the specific directions through the elastic layer 4b. Therefore, it improves the elastic layer 4b (pressure roller 4) in thermal conductivity. In this embodiment, therefore, the elastic layer 4b is formed in such a manner that numerous carbon fibers point in the direction which is practically parallel to the lengthwise direction (parallel to rotational axis of pressure roller 4) of the elastic layer 4b, or the direction parallel to the circumferential direction (rotational direction) of the pressure roller 4. Thus, the elastic layer 4b of the pressure roller 4 in this embodiment is higher in the thermal conductivity in the lengthwise direction of the elastic layer 4b, and also, the circumferential direction of the pressure roller 4. On the other hand, forming the elastic layer 4b as described above can reduce the elastic layer 4b in the thermal conductivity in the thickness direction. Incidentally, this embodiment is not intended to limit the present invention in scope in terms of the direction in which the carbon fibers are made to point, to a case where the direction in which carbon fibers point are parallel to the lengthwise or circumferential direction the pressure roller 4. That is, the present invention is applicable to a case where the direction in which carbon fibers point intersects with the lengthwise or circumferential direction of the pressure roller 4 within a range in which their relationship related to the thermal conductivity, which will be described later, is satisfied.

Increasing the pressure roller 4 in the heat transmission in the lengthwise direction can reduce in severity the unwanted temperature increase of the out-of-sheet-path portions. However, in a case where the out-of-sheet-path portions are wide, that is, the heat conduction in the lengthwise direction may be insufficient, increasing the elastic layer 4b in the heat conduction in the circumferential direction can further reduce the temperature increase which occurs to the out-of-sheet-path portions.

As for the shape of the pitch-based carbon fiber, it is desired to be 5 μm-11 μm in diameter D, and 50 μm-1,000 μm in length L (average length). Pitch-based carbon fibers which are as described above in shape and dimension, are easily obtainable.

Here, the ratio (volumetric ratio) of the needle-shaped filler 4b1 relative to the entirety of the elastic layer 4b is desired to be in a range of 5-50%. Forming the elastic layer 4b so that the amount by which needle-shaped filler 4b1 are contained in the elastic layer 4b falls in the above described range can ensure that the elastic layer 4b is desirably high in thermal conduction. Further, it makes it unlikely for the presence of the carbon fibers in the elastic layer 4b to seriously affect the moldability of the elastic layer 4b.

Regarding the effectiveness of the present invention, fillers, additives, and the like, which are different from those stated in this specification, may be contained as means for solving the known problems, as long as they do not adversely affect the characteristics of the present invention.

<Method for Manufacturing Pressure Roller>

The following is the method for manufacturing the pressure applying rotational member which is effective to minimize the temperature increase of the out-of-sheet-path portions, to reduce a fixing device in the length of startup time, and also, to minimize a fixing device in the nonuniformity in temperature in terms of the lengthwise direction of the member.

(i) Process for Mixing Components for Liquid Compound

The above-described needle-shaped fillers 4b1 and the water-absorbent polymer soaked with water are mixed into the adductively hardenable liquid silicone rubber which has not been subjected to cross-linking process (hardening process). More specifically, a preset amount of liquid silicone rubber, a preset amount of needle-shaped fillers 4b1, and a preset amount of water-absorbent polymer soaked with water can be obtained with the use of a weighing instrument, and be mixed with the use of a mixing/stirring means such as a universal mixing/stirring machine, to disperse the needle-shaped fillers 4b1 and water-soaked absorbent polymer in the liquid silicone.

(ii) Process for Forming Liquid Compound into Elastic Layer

The liquid compound is injection-molded into the elastic layer 4b with the use of one of known methods. More concretely, first, the substrate 4a is primed in advance with the use of one of the known priming methods, and is placed in a metallic mold. Then, the liquid compound is injected into the mold while being made to flow in the direction parallel to the axial line of the substrate 4a as well as the direction parallel to the circumferential direction of the substrate 4a. As the liquid compound is injected into the mold in the above-described manner, the needle-shaped fillers 4b1 in the liquid compound point in the direction parallel to the lengthwise or circumferential direction of the elastic layer 4b. Thus, the resultant elastic layer 4b is higher in thermal conductivity in both the lengthwise and circumferential directions of the elastic layer 4b (pressure roller 4) than a conventional elastic layer (pressure roller 4).

By the way, the method for forming the elastic layer 4b does not need to be limited to the above described one. That is, any method may be used as long as it allows the liquid compound to be injected into the mold while being made to flow in the direction parallel to the lengthwise and circumferential direction of the substrate 4a. Further, the liquid compound may be made to flow in both directions at the same time, or in sequence. That is, the liquid compound may be made to flow, first, in the direction parallel to the axial line of the substrate 4a, and then, in the direction parallel to the circumferential direction of the substrate 4a. If it is possible to make the elastic layer 4b remain adhered to the substrate 4b without priming the substrate 4b, the process for priming the substrate 4a may be skipped.

(iii) Cross-Linking Process for Hardening Liquid Silicone Rubber

The mold filled with the liquid compound is sealed, and heated for 5-120 minutes at a temperature level which is lower than the boiling point of water, to cause the silicone rubber ingredients to cross-link, in order to harden the liquid compound. The temperature level at which the mold, which is holding the liquid compound, is to be heated is desired to be in a range of 60-90°. The liquid compound is heated while remaining sealed in the mold. Therefore, the silicone rubber ingredients can be made to cross-link while the water in the water-absorbent component of the liquid compound remains sealed in the liquid compound.

During the sub-process (which will be described later) for causing the water to evaporate before the liquid compound will completely solidify, a nonporous sub-layer (which hereafter will be referred to as skin layer) is formed. The skin layer is higher in density, being therefore higher in volumetric specific heat, than the porous portion of the elastic layer 4*b*. Therefore, the presence of the skin layer is not desirable, from the standpoint of reducing the length of the startup time. Thus, it is desired that this sub-process is carried out with the metallic mold kept sealed.

(iv) Process for Removing Pressure Roller from Mold

After the metallic mold is sufficiently cooled with air or water, the substrate 4*a* covered with the elastic layer 4*b*, that is, the solid silicone rubber layer hardened by cross-linking, is removed from the metallic mold.

(v) Dehydration Process

The solidified layer formed of the liquid compound, on the peripheral surface of the substrate 4*a* is heated to cause the water in the water-absorbent ingredient in the solidified layer to evaporate, in order to dehydrate the solidified layer to create pores 4*b* in the solidified layer. As for the condition for heating the layer of solidified liquid compound, it is desired that the layer is heated at a temperature in a range of 100° C.-250° C., for 1-5 hours.

(vi) Process for Laying Parting Layer on Elastic Layer

The surface of the elastic layer 4*b* is coated with adhesive. Then, the elastic layer 4*b* coated with adhesive is covered with a piece of tube, as the parting layer, made of fluorinated resin. If it is possible to cause the parting layer 4*c* to adhere to the elastic layer 4*b* without using adhesive, the step for applying adhesive to the surface of the elastic layer 4*b* may be skipped. Incidentally, it is not mandatory that the step for forming the parting layer 4*c* is the last step in the process for manufacturing the pressure roller 4. For example, the parting layer 4*c* can be layered upon the peripheral surface of the elastic layer 4*b* by placing in advance a piece of fluorinated resin tube in the metallic mold, and then, injecting the liquid compound into the mold. Further, it can be formed by forming, first, the elastic layer 4*a*, and then, coating the elastic layer 4*b* with fluorinated resin with the use of a known method.

<Thermal Conductivity of Elastic Layer 4*b* of Pressure Roller>

At this time, the elastic layer 4*b* is described regarding its thermal conductivity. Here, its thermal conductivity in terms of the direction parallel to its axial line is referred to as λMD, and its thermal conductivity in terms of its thickness direction is referred to as λND. Further, its thermal conductivity in terms of the direction parallel to its rotational direction is referred to as λTD. Further, the ratio of the thermal conductivity λMD relative to the thermal conductivity λND is referred to as α1 (=λMD/λND), and the ratio of the thermal conductivity λTD relative to the thermal conductivity λND is referred to as α2 (=λTD/λND). In the case of this embodiment, both α1 and α2 are desired to be no less than 6, and no more than 900.

In a case where the thermal conductivity ratio α1 is no more than 6, it is possible that the effect of reducing the unwanted temperature increase of the out-of-sheet-path portions will not be satisfactorily obtained. Further, in a case where the thermal conductivity ratio α2 is no more than 6, it is possible that the pressure roller 4 will become nonuniform in temperature in terms of its rotational direction, and therefore, it will be impossible to obtain high quality images. If it is desired to make the thermal conductivity ratios α1 and α2 greater than 900, the liquid compound has to be increased in the amount of needle-shaped fillers 4*b*1 and pores. However, increasing the liquid compound in the content of the needle-shaped fillers 4*b*1 makes it more difficult to form the elastic layer 4*b* by injection molding. As for the thermal conductivity λND, that is, the thermal conductivity of the elastic layer 4*b* in terms of the thickness direction of the elastic layer 4*b*, it is desired to be no less than 0.08 W/(m·K) and no more than 0.6 W/(m·K). If it is no more than 0.08 W/(m·K), it may be difficult to form the elastic layer 4*b*, and/or the elastic layer 4*b* may have too much pores for the pressure roller 4 to be strong enough to be used for a fixing device. On the other hand, if it is no less than 0.6 W/(m·K), the elastic layer 4*b* may not be satisfactory in terms of the reduction of the length of the startup time.

(4) Examples of Pressure Roller in Accordance with Present Invention

The substances used as the materials for the pressure roller 4 in this embodiment are as follows. The material for the substrate 4*a* is a piece of iron rod, which is 22.8 mm in diameter, and 320 mm in the length of its portion to be covered with the rubber layer (elastic layer 4*b*). The hydrating material is RHEOGIC 250 H (product of Toagosei Co., Ltd.) soaked with water. The ratio of Reojikku 250 H relative to the Reojkku soaked with water was adjusted to 1 wt. %. The material for the parting layer 4*c* was fluorinated resin (PFA) tube (product of Gunze Co., Ltd.), which was 50 μm in thickness and had been processed in advance across its internal surface. The needle-shaped filler 4*b*1 was one of the following pitch-based carbon fibers.

<Commercial Name: XN-100-05M (Product of Nippon Graphite Fiber Co., Ltd.)>

Average fiber diameter D: 9 μm

Average fiber length L: 50 μm

Thermal conductivity: 900 W/(m·K)

This needle-shaped filler will be referred to as 100-05M, hereafter.

<Commercial Name: XN-100-15M (Product of Nippon Graphite Fiber Co., Ltd.)>

Average fiber diameter D: 9 μm

Average fiber length L: 150 μm

Thermal conductivity: 900 W/(m·K)

This needle-shaped filler will be referred to as 100-15M, hereafter.

<Commercial Name: XN-100-01Z (Product of Nippon Graphite Fiber Co., Ltd.)>

Average fiber diameter D: 9 μm

Average fiber length L: 1,000 μm

Thermal conductivity: 900 W/(m·K)

This needle-shaped filler will be referred to as 100-01Z, hereafter.

Incidentally, in this embodiment, the elastic layer 4*b* and substrate 4*b* are adhered to each other with the use of one of the following adhesives, and the elastic layer 4*b* and parting layer 4*c* are adhered to each other with the use of the other.

More specifically, for the adhesion between the elastic layer 4*b* and substrate 4*a*, liquids A and B of "DY39-051" (commercial name: product of Dow Corning Toray Co., Ltd.) was used. For the adhesion between the elastic layer 4*b* and parting layer 4*c*, liquids A and B of "SE1819CV" (commercial name: product of Dow Corning Toray Co., Ltd.) were used.

The pressure roller 4 in this embodiment was manufactured through the following processes. In the process for mixing the components for the liquid compound, the above-described various substances were mixed with the use of a universal mixing/stirring machine. Then, the resultant liquid compound was injected into a cylindrical mold, in which the substrate 4*a* coated with primer had been disposed. Then, the mold was sealed. In the process for hardening the liquid compound (mixture of liquid silicone rubber, fillers, additive, etc.), the mold was heated at 90° C. in a hot air oven, for an hour. In the dehydration process, first, the mold was cooled with water. Then, the mold was removed. Then, the resultant combination of the substrate 4*a* and hardened elastic layer 4*b* was heated in a hot air over, at 200° C., for four hours. Lastly, the combination was covered with a piece of tube made of fluorinated resin (PFA) as the parting layer 4*c*, with the placement of the abovementioned adhesive between the elastic layer 4*b* and parting layer 4*c*.

Example 1

This example was obtained through the following processes. First, needle-shaped filler [100-01Z] and hydrating agent were mixed into adductively hardenable liquid silicone rubber by 40% and 40%, respectively, in volume to obtain the liquid compound. Then, the liquid compound was injected into a mold, and hardened. Then, the hardened compound was removed from the mold, and dehydrated. Then, it was put through the process for laying the parting layer on the elastic layer 4*b*.

Examples 2-5

The second to fifth examples of the pressure roller 4 in accordance with the present invention were obtained using the liquid compounds prescribed in Table 1, and also, the same method as the one used to obtain the first example.

Example 1 of Comparative Pressure Roller

Instead of the above-described liquid compound, a liquid silicone rubber which does not contain the needle-shaped fillers nor hydrate, and can yield such an elastic layer (4*b*1) that is 0.6 W/(m·K) in thermal conductivity was used as the material for the elastic layer. The manufacturing method for Example 1 is similar to the one used for the preceding examples of the pressure rollers which are in accordance with the present invention. Since this example of comparative pressure roller was manufactured using the material (liquid silicone rubber) which did not contain needle-shaped fillers nor hydrating agent, its elastic layer 4*b* did not have needle-shaped fillers 4*b*1 nor pores.

Example 2 of Comparative Pressure Roller

A liquid compound which contained the needle-shaped fillers, but did not contain hydrating agent was used in place of the above described liquid compound to yield the second comparative example of pressure roller, the specifications of which are as shown in Table 1. The manufacturing method for Example 2 is similar to the one used for the preceding examples of the pressure rollers which are in accordance with the present invention. Since this example of comparative pressure roller was manufactured using the material which contained needle-shaped fillers, but did not contain hydrate, its elastic layer 4*b* had no pores.

Example 3 of Comparative Pressure Roller

The material for this pressure roller is the same as the one for the one in the first embodiment. The manufacturing method for this pressure roller is similar to the one for the pressure roller 4 in the first embodiment, except that in the case of the manufacturing method for this example of comparative pressure roller, the liquid compound was made to flow only in the circumferential direction of the pressure roller 4 to obtain a pressure roller, the needle-shaped fillers of which point in the circumferential direction of the pressure roller 4.

Example 4 of Comparative Pressure Roller

The material for this pressure roller is the same as the one for the pressure roller in the first embodiment. The manufacturing method for this pressure roller is similar to the one for the pressure roller 4 in the first embodiment, except that in the case of this example of comparative pressure roller, the liquid compound was made to flow only in the lengthwise direction of the pressure roller 4 to obtain a pressure roller, the needle-shaped fillers of which point in the lengthwise direction of the pressure roller.

Example 5 of Comparative Pressure Roller

The manufacturing method for this pressure roller was the same as the one for the pressure roller 4 in the first embodiment. The liquid compound for this pressure roller 4 contained Needle-shaped filler [100-01] and hydrating agent by 45% and 10%, respectively, in volume. In this case, it was difficult to form the elastic layer 4*b*, and the resultant example 5 of comparative pressure roller was not worthy of evaluation.

Example 6 of Comparative Pressure Roller

The manufacturing method for this pressure roller was the same as the one for the pressure roller 4 in the first embodiment. The liquid compound for this pressure roller 4 contained Needle-shaped filler [100-05M] and hydrating agent by 5% and 80%, respectively, in volume. Also in this case, it was difficult to form the elastic layer 4*b*, and the resultant example 6 of comparative pressure roller was not worthy of evaluation.

Example 7 of Comparative Pressure Roller

The manufacturing method for this pressure roller was the same as the one for the pressure roller 4 in the first embodiment. The liquid compound for this pressure roller 4 contained Needle-shaped filler [100-05M] and hydrating agent by 2% and 40%, respectively, in volume. The specifications of the resultant pressure roller are as shown in Table 1.

(Evaluation Method)

<Thermal Conductivity in Terms of Thickness, Axial, and Circumferential Directions)

Figure 8:
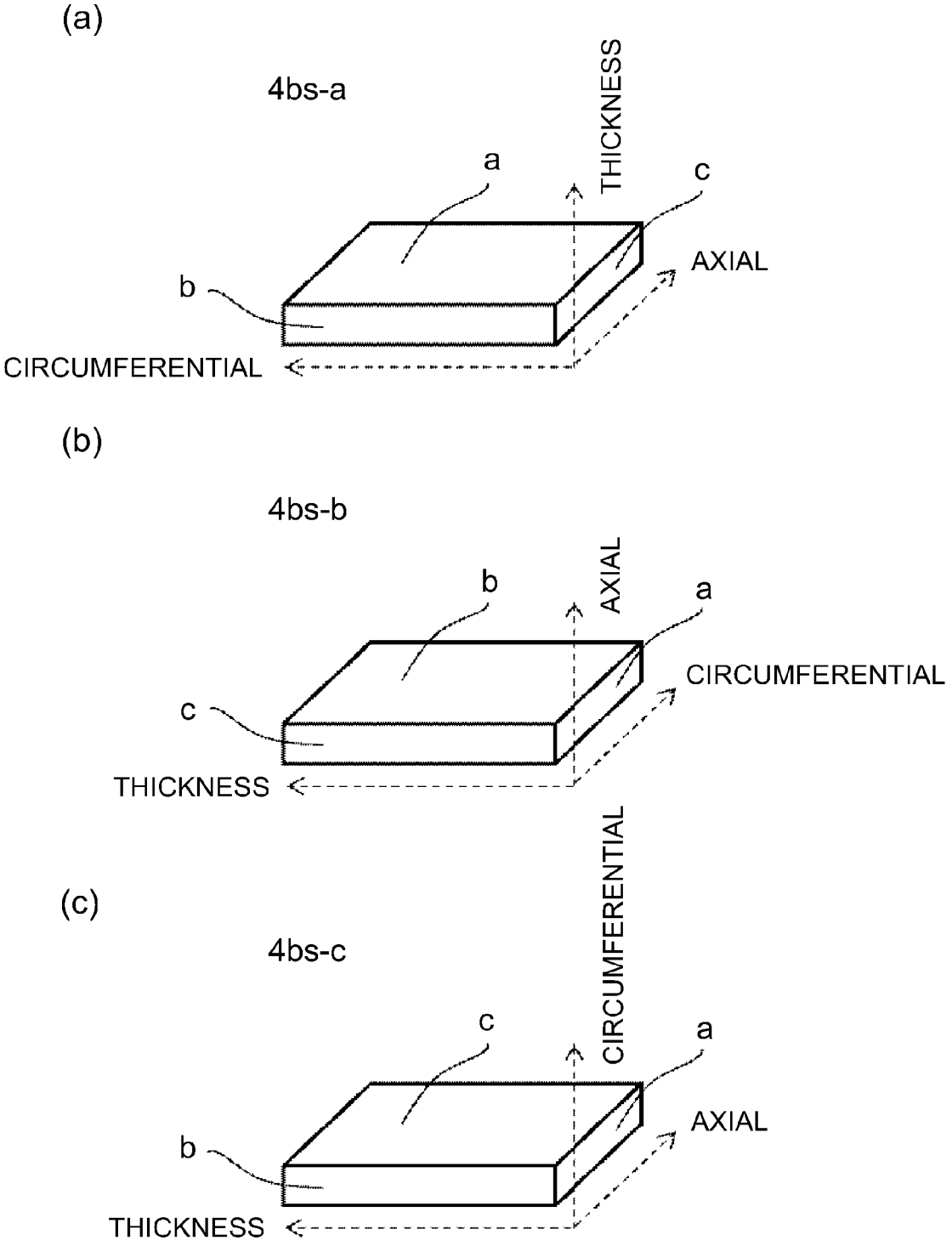
FIG. 8 is a schematic drawing for showing the method for measuring the thermal conductivity of the sample piece of the elastic layer.

Samples 4*bs-a*, 4*bs-b* and 4*bs-c* of the elastic layer 4*b* of the pressure roller 4 were measured in thermal conductivity in the following manner. First, they were measured in the thermal conductivity in the thickness direction. Next, referring to FIG. 8, the method used to measure the thermal conductivity of the elastic layer 4*b* of the pressure applying rotational member in the thickness, axial, and circumferential directions, is described. FIG. 8(*a*) is a schematic perspective view of the sample 4*bs-a* which was cut out of the elastic layer 4*b* so that its edges became parallel to the circumferential, axial, or thickness direction, and also, that the edges parallel to the circumferential direction and the edges parallel to the axial direction had preset dimension, and the edges parallel to the thickness direction became no more than 1.5 mm.

This sample was sandwiched by a micro-heater and a sensor from the direction perpendicular to the surface a, and its thermal conductivity was measured. The sensor was a temperature wave analysis thermal property measuring apparatus ai-Phase Mobile (product of ai-Phase Co., Ltd.).

In order to measure the thermal conductivity of the elastic layer 4*b* in terms of the axial and circumferential directions, the samples 4*bs-b* and 4*bs-c* were prepared, respectively. Then, the samples were measured in thermal conductivity with the use of the same method as the above described method. More specifically, the samples were measured five times for each of the thermal conductivities in the thickness, axial, and circumferential directions. Then, the average of the five measurements was used as the value for the thermal conductivities. Then, $\alpha 1$ (=$\lambda$MD/$\lambda$ND), which is the ratio of the thermal conductivity $\lambda$MD in the axial direction relative to the thermal conductivity $\lambda$ND in the thickness direction, and $\alpha 2$ (=$\lambda$TD$\lambda$ND), which is the ratio of the thermal conductivity $\lambda$TD relative to the thermal conductivity $\lambda$ND $\alpha$, were calculated.

<Unwanted Temperature Increase of Out-of-Sheet-Path Portions>

For the evaluation of the unwanted temperature increase which occurs across the out-of-sheet-path portions of a pressure roller, the first to fifth examples of pressure rollers in accordance with the present invention, and examples 1-4 of comparative pressure rollers (comparative pressure rollers 5 and 6 were not worthy of evaluation, and therefore, are not listed), were tested with the use of the fixing device 110, shown in FIG. 2, which is of the heating belt type.

The pressure rollers 4 were mounted in the fixing device 110, and the fixing device 110 was adjusted so that the peripheral surface of the pressure roller 4 became 234 mm/sec, and the heater temperature was set to 190° C. Then, the surface temperature of the portions of the film 3, which were outside the sheet path (portions of sheet passage, which sheets of recording paper of size A4 do not pass when they are conveyed in portrait attitude), immediately after 500 sheets of recording paper of size A4 (GF-C104: product of Canon Co., Ltd.) were continuously conveyed through the fixing device 110 when the ambient temperature and humidity were 15° C. and 15%, respectively. The instrument used to measure the temperature of the film 3 was an infra-red thermography FSV-7000S (product of Apiste. Co., Ltd.).

<Length of Startup Time>

In order to evaluate the length of time it takes for the fixing device 110 to start up, the length of time it took for the surface temperature of the belt 3 to reach 180° C. after the heater switch is turned on while the fixing device 110 is idled, that is, while no sheet of recording medium is conveyed through the fixing device 110 was measured.

<Evaluation of Fixing Device in Terms of Prevention of Formation of Images which are Nonuniform in Gloss>

In order to evaluate the pressure rollers in terms of the nonuniformity in gloss of images, a sheet of coated paper (OK topcoat+157: product of Oji Paper Co., Ltd.), on which an unfixed toner image was present, was conveyed through the fixing device 110 after the surface temperature of the film 3 reached 180° C. Then, the obtained image was visually examined in the nonuniformity in gloss in terms of the direction in which the sheet was conveyed.

<Result of Evaluation>

Shown in Table 1 are the specifications, physical properties, and out-of-sheet-path portion temperature, of the elastic layer 4*b* of each of examples 1-5 of the pressure rollers 4 in accordance with the present invention, and examples 1-4 of comparative pressure roller, and their evaluations in terms of the length of startup time.

TABLE 1

| | Fillers | | | Thermal conductivity | | | Ratio | | Non-Sheet | Start-up | Gloss Diff. |
|---|---|---|---|---|---|---|---|---|---|---|---|
| | Kinds | Cont. (vol %) | Porosity (vol %) | Axial (W/m · K) | Circum. (W/m · K) | Thick. (W/m · K) | $\alpha 1$ ($\lambda$ MD/ $\lambda$ ND) | $\alpha 2$ ($\lambda$ TD/ $\lambda$ ND) | Temp. (° C.) | Time (sec) | Prevent Effect |
| Emb. 1 | 100-01Z | 40 | 40 | 86.0 | 87.6 | 0.27 | 318 | 324 | 251 | 18.2 | Y |
| Emb. 2 | 100-05M | 5 | 30 | 2.5 | 2.5 | 0.39 | 6 | 6 | 285 | 19.4 | Y |
| Emb. 3 | 100-15M | 5 | 70 | 2.4 | 2.4 | 0.08 | 30 | 30 | 288 | 13.2 | Y |
| Emb. 4 | 100-15M | 25 | 25 | 20.0 | 21.3 | 0.33 | 61 | 65 | 260 | 21.1 | Y |
| Emb. 5 | 100-15M | 5 | 35 | 2.5 | 2.5 | 0.25 | 10 | 10 | 287 | 18.4 | Y |
| Comp. Ex. 1 | | 0 | 0 | 0.6 | 0.6 | 0.60 | 1 | 1 | 310 | 24.1 | N |
| Comp. Ex. 2 | 100-15M | 12 | 0 | 3.6 | 3.5 | 1.50 | 2 | 2 | 275 | 26.1 | Y |
| Comp. Ex. 3 | 100-05M | 5 | 30 | 0.6 | 2.8 | 0.38 | 2 | 7 | 305 | 19.3 | Y |
| Comp. Ex. 4 | 100-05M | 5 | 30 | 2.7 | 0.4 | 0.22 | 12 | 2 | 283 | 18.5 | N |
| Comp. Ex. 7 | 100-05M | 2 | 30 | 0.9 | 0.9 | 0.22 | 4 | 4 | 299 | 18.2 | N |

In the case of example 1 of comparative pressure roller, the out-of-sheet-path portion temperature was 310° C. If it is no higher than this temperature (310° C.), it can be said that the pressure roller 4 is effective to prevent the occurrence of the unwanted increase in the temperature of the out-of-sheet-path portion. As for the length of the startup time, it was 24.1 seconds. If it is shorter than 21.7 seconds, which is 10% shorter than 24.1 seconds, it can be said the pressure roller was effective to reduce the length of the startup time.

In the case of Examples 1-5 of the pressure roller in accordance with the present invention, the needle-shaped fillers 4*b*1 were made to point in the circumferential or axial line direction. Therefore, they were higher in the thermal conductivity in the circumferential direction and axial line direction, and therefore, were effective to prevent the out-of-sheet-path portions of the recording medium conveyance passage from unwantedly increasing in temperature. Further, they are not problematic regarding the nonuniformity in gloss of a fixed image. Further, they were no less than 6 in both the thermal conductivity ratios $\alpha 1$ and $\alpha 2$, and therefore, were effective to shorten the length of startup time.

Example 2 of comparative pressure roller were effective to reduce the length of startup time, and also, effective to prevent the fixing device from yielding images which are nonuniform in gloss. However, its elastic layer 4*b* did not contain pores. Therefore, its thermal conductivity in terms of the thickness direction was substantially higher than 0.6 W/(m·K). Thus, it was 26.1 seconds in the length of the startup time. That is, it was not noticeably effective to reduce the length of the startup time.

Example 3 of comparative pressure roller also were effective to reduce the length of the startup time, and also, effective to prevent the fixing device from yielding images which are nonuniform in gloss. However, it was small in the thermal conductivity ratio $\alpha 1$. Therefore, it was not noticeably effective to prevent the problem that the out-of-sheet-path portions of the recording medium passage unwantedly increase in temperature.

Example 4 of comparative pressure roller also were effective to reduce the length of the startup time, and also, effective to prevent the fixing device from yielding images which are nonuniform in gloss. However, it was small in the thermal conductivity ratio $\alpha 2$. Therefore, it was not noticeably effective to prevent the problem that the fixing device yield images which are nonuniform in gloss.

Example 5 of comparative pressure roller was smaller in the needle-shaped filler content, being therefore small in both thermal conductivity ratios $\alpha 1$ and $\alpha 2$. Therefore, it was not noticeably effective to prevent the problem that the out-of-sheet-path portions of the recording medium passage unwantedly increase in temperature, nor to prevent the fixing device from yielding images which are not uniform in gloss.

As descried above, the elastic layer 4*b* of the pressure roller 4 in accordance with the present invention is characterized in that its thermal conductivity in terms of both its lengthwise and circumferential directions is no less than six times, and no more than 900 times, relative to its thermal conductivity in terms of its thickness direction (it is anisotropic in thermal conductivity).

More concretely, the elastic layer 4*b* contains needle-shaped fillers 4*b*1, which were made to point in the lengthwise or circumferential direction of the pressure roller 4 to make the thermal conductivity of the pressure roller 4 in terms of the lengthwise and circumferential directions, no less than 6 times and no more than 900 times the thermal conductivity of the pressure roller 4 in terms of its thickness direction.

Therefore, this embodiment can provide a pressure applying rotational member which can minimize a fixing device in the unwanted temperature increase of the out-of-sheet-path portions of the pressure roller, reduce the fixing device in the length of the startup time, and enable a fixing device to reliably output fixed images of high quality, more specifically, images which are uniform in gloss, and an image heating apparatus (device) equipped with the pressure applying rotational member.

The heater 2 to be employed by the fixing device 110 in the first embodiment does not need to be limited to a ceramic heater. It may be a nickel-chrome wire heater or a heating member based on electromagnetic induction. Further, the belt 3 itself may be provided with a layer of heat generating resistor so that belt 3 itself generates heat.

Embodiment 2

Figure 9:
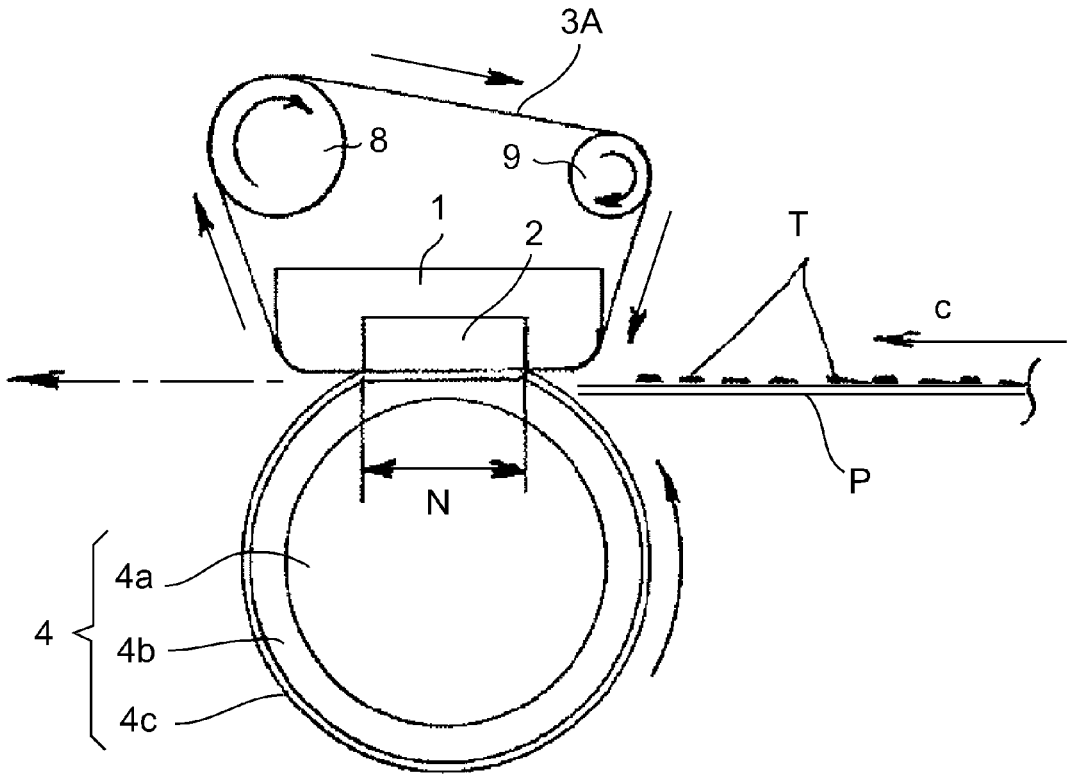
FIG. 9 is a schematic sectional view of a fixing device (1) different in structure from the fixing device in the first embodiment of the present invention.
Figure 10:
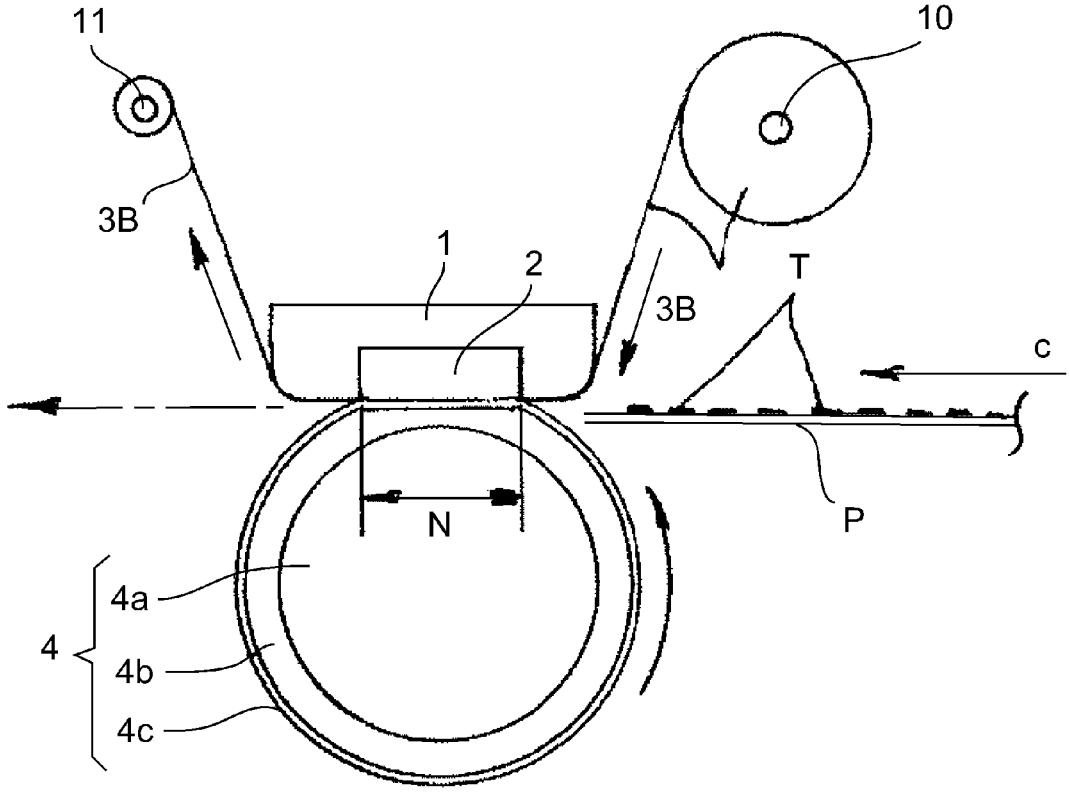
FIG. 10 is a schematic sectional view of a fixing device (2) different in structure from the fixing device in the first embodiment of the present invention.
Figure 11:
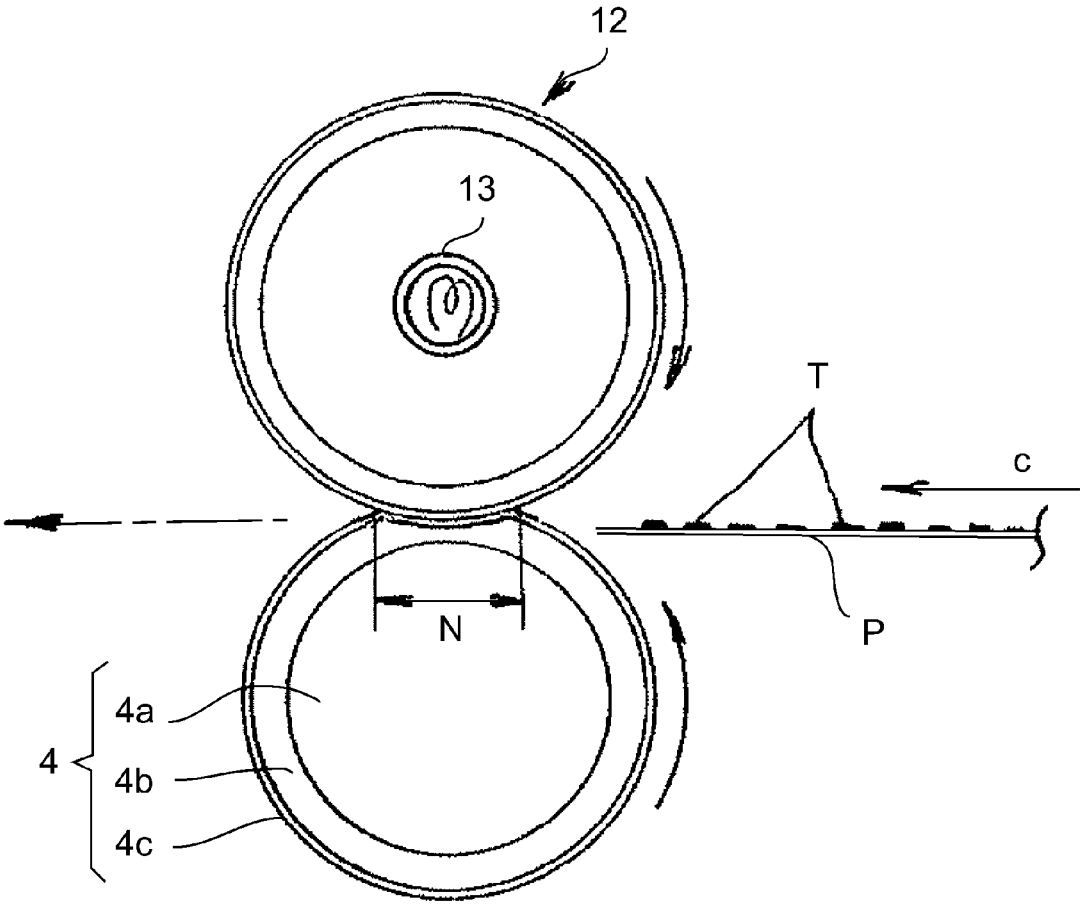
FIG. 11 is a schematic sectional view of a fixing device (3) different in structure from the fixing device in the first embodiment of the present invention.

An image forming apparatus to which the present invention is applicable is not limited to the image heating device 110 in the first embodiment. FIGS. 9, 10, and 11 are schematic drawings of image heating apparatuses which are different in structure from the fixing device 110 in the first embodiment. They shows the general structure of the image heating apparatuses.

(1) The apparatus shown in FIG. 9 has a flexible endless belt (heating belt) 3A, and multiple (three) belt supporting members 1, 8 and 9, by which the endless belt 3A is suspended and kept tensioned. The endless belt 3A is circularly driven by the belt supporting roller 8, as a belt driving member, which is driven by a motor.

Further, the heating apparatus is provided with a heater (heat source), which is on the inward side of the belt loop, and is supported by a heater supporting member 1 so that it remains in contact with the inward surface of the belt 3. As in the case of the above described embodiment, the fixing device may be structured so that the pressure roller 4 as an pressure applying rotational member which forms the nip N by being pressed against the heater 2 with the placement of the belt 3A between itself and heater 2. Also in the case of this fixing device, a sheet P of recording paper is heated while it is conveyed through the nip N, remaining pinched between the pressure roller 4 and belt 3A.

The heater 2 may be a ceramic heater, a nickel-chrome wire heater, or a heating member based on electromagnetic induction. Further, the belt 3 is provided with a layer of heat generating resistor to cause the belt 3 itself to generate heat.

(2) The apparatus shown in FIG. 10 uses a roll of flexible belt (heating belt) 3B which is drawn out of a feeding section, and taken up by a take-up section. Further, the apparatus is provided with a stationary heater (heat source) 2 which is supported by a stationary heater supporting member 1, between the belt feeding section and belt take-up section, in contact with the inward surface of the belt 3B, on the inward side of the belt loop. This apparatus may also be structured so that the pressure roller 4, as an pressure applying rotational member, is pressed against the heater 2 with the placement of the belt 3B between itself and heater 2 to form the nip N. Also in the case of this fixing device, a sheet P of recording paper is heated while it is conveyed through the nip N, remaining pinched between the pressure roller 4 and belt 3B.

(3) The apparatus shown in FIG. 11 employs a heat roller (fixation roller) 12 as a rotational heating member. The heat roller 12 is heated from within itself by a halogen heater 13 or the like heat source disposed in the hollow of the heat roller 12 so that its surface temperature remains at a preset fixation temperature level. Also in the case of this apparatus, the pressure roller 4 as a pressure applying rotational member forms the nip N by being pressed against the heat roller 12, and a sheet P of recording paper is heated while it is conveyed through the nip N, remaining pinched between the pressure roller 4 and belt 3, as in the case of the apparatus in one of the preceding embodiments.

The apparatus may be structured so that the heat roller 12 is externally heated by a heat source. Further, the apparatus may be structured so that the heat roller 12 can be heated by electromagnetic induction, or the heat roller 12 may be provided with a layer of heat generating resistor to enable the heat roller 12 to generate heat.

The pressure roller 4, as a pressure applying rotational member, of each of the apparatuses shown in FIGS. 9-11 is similar in structure as the pressure roller 4 in the above described first embodiment. Further, the apparatus may be structured so that the pressure roller 4 is rotated by the movement of the heat belt 3A (FIG. 9), or 3B (FIG. 10), or a heat roller 12 (FIG. 11), which is circularly or rotationally driven. Further, the apparatus may be structured so that the pressure roller 4 also is heated.

<<Miscellanies>>

(1) The pressure applying rotational member does not need to be in the form of a roller. It may be a flexible endless belt, which is made up of a substrative layer and an elastic layer laid on the outward surface of the substrative layer, and is suspended and kept tensioned by multiple members in such a manner that it can be circularly driven.

(2) Not only does an image heating apparatus include the fixing device 110 which heats an unfixed toner image (developed image, image formed of developer) T to permanently or temporarily fix the unfixed toner image, but also, an apparatus which reheats a fixed toner image to alter the fixed toner image in surface properties such as glossiness.

(4) The image forming section of an image forming apparatus does not need to be electrophotographic. It may be electrostatic or magnetic. Further, it does not need to be of the intermediary transfer type. For example, it may be structured so that a toner image is directly formed on recording medium.

(5) Not only is the fixing device 110 in the preceding embodiments is compatible with the electrophotographic printer in the preceding embodiments, but also, a monochromatic or full-color image forming apparatus, a copying machine, a facsimile machine, a printer, and a multifunction machine capable of functioning as two or more of the preceding devices. That is, not only is the present invention applicable to a fixing device and an image forming apparatus, such the fixing device 110 and electrophotographic printer in the preceding embodiments, but also, a fixing device and an image forming apparatus, which are partially or totally different in structural components and their combination.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 187234/2013 filed Sep. 10, 2013, which is hereby incorporated by reference.

What is claimed is:

1. A pressing rotatable member for use with an image heating apparatus, said pressing rotatable member comprising:

a base layer; and a porous elastic layer provided on said base layer, wherein said elastic layer has a thermal conductivity in an axial direction thereof and a thermal conductivity in a circumferential direction thereof which are not less than 6-times and not more than 900-times a thermal conductivity in a thickness direction thereof.

2. A pressing rotatable member according to claim 1, wherein the thermal conductivity of said elastic layer in the thickness direction thereof is not less than 0.08 W/(m·K) and not more than 0.6 W/(m·K).

3. A pressing rotatable member according to claim 1, wherein said elastic layer has a porosity not less than 10% by volume and not more than 70% by volume.

4. An image heating apparatus comprising:

a heating rotatable member for heating a toner image on sheet; and a pressing rotatable member configured to cooperate with said heating rotatable member to form a nip, wherein said pressing rotatable member includes a base layer and a porous elastic layer provided on said base layer, wherein said elastic layer has a thermal conductivity in an axial direction thereof and a thermal conductivity in a circumferential direction thereof which are not less than 6-times and not more than 900-times a thermal conductivity in a thickness direction thereof.

5. An apparatus according to claim 4, wherein the thermal conductivity of said elastic layer in the thickness direction thereof is not less than 0.08 W/(m·K).

6. An apparatus according to claim 4, wherein said elastic layer has a porosity not less than 10% by volume and not more than 70% by volume.

7. A pressing rotatable member for use with an image heating apparatus, said pressing rotatable member comprising:

a base layer; and a porous elastic layer provided on said base layer, wherein said elastic layer comprises needle-like filler so that a thermal conductivity in an axial direction thereof and a thermal conductivity in a circumferential direction thereof are not less than 6-times and not more than 900-times a thermal conductivity in a thickness direction thereof.

8. An apparatus according to claim 7, wherein the thermal conductivity of said elastic layer in the thickness direction thereof is not less than 0.08 W/(m·K) and not more than 0.6 W/(m·K).

9. An apparatus according to claim 7, wherein said needle-like filler has a thermal conductivity of not less than 500 W/(m·K).

10. An apparatus according to claim 7, wherein said needle-like filler has an average length of not less than 50 μm and not more than 1000 μm.

11. An apparatus according to claim 7, wherein said elastic layer contains not less than 5% and not more than 40% by volume of said needle-like filler.

12. An apparatus according to claim 7, wherein said needle-like filler is made of carbon fibers.

13. An apparatus according to claim 7, wherein said elastic layer has a porosity of not less than 10% and not more than 70% by volume.

14. An image heating apparatus comprising:

a heating rotatable member for heating a toner image on sheet; and a pressing rotatable member configured to cooperate with said heating rotatable member to form a nip;

wherein said pressing rotatable member includes a base layer and a porous elastic layer provided on said base layer, wherein said elastic layer comprises needle-like filler so that a thermal conductivity in an axial direction thereof and a thermal conductivity in a circumferential direction thereof are not less than 6-times and not more than 900-times a thermal conductivity in a thickness direction thereof.

15. An apparatus according to claim 14, wherein the thermal conductivity of said elastic layer in the thickness direction thereof is not less than 0.08 W/(m·K) and not more than 0.6 W/(m·K).

16. An apparatus according to claim 14, wherein said needle-like filler has a thermal conductivity of not less than 500 W/(m·K).

17. An apparatus according to claim 14, wherein said needle-like filler has an average length of not less than 50 μm and not more than 1000 μm.

18. An apparatus according to claim 14, wherein said elastic layer contains not less than 5% and not more than 40% by volume of said needle-like filler.

19. An apparatus according to claim 14, wherein said needle-like filler is made of carbon fibers.

20. An apparatus according to claim 14, wherein said elastic layer has a porosity not less than 10% by volume and not more than 70% by volume.

* * * * *